US005975318A

United States Patent [19]

Jay

[11] Patent Number: 5,975,318

[45] Date of Patent: Nov. 2, 1999

[54] DISPLAY SHELF ASSEMBLY AND BRACKET USEFUL THEREIN

[75] Inventor: Richard Jay, Westport, Conn.

[73] Assignee: Display Technologies, Inc., Whitestone, N.Y.

[21] Appl. No.: 09/023,862

[22] Filed: Feb. 13, 1998

[51] Int. Cl.[6] ..... A47F 5/08; A47B 96/06; A47G 29/02

[52] U.S. Cl. ..... 211/90.01; 211/150; 211/187; 248/220.43; 248/242; 248/220.22

[58] Field of Search ..... 248/220.22, 220.43, 248/242, 225.21, 243, 250; 211/90.01, 88.01, 150, 153, 96, 187

[56] References Cited

U.S. PATENT DOCUMENTS

| | | | |
|---|---|---|---|
| 2,956,766 | 10/1960 | Galassi | 248/243 |
| 2,963,170 | 12/1960 | Lori | 248/242 |
| 3,081,717 | 3/1963 | Yurevich | 248/243 |
| 3,085,693 | 4/1963 | Shell | 248/243 |
| 3,286,976 | 11/1966 | Lynch | 248/243 |
| 3,426,993 | 2/1969 | Johansso | 248/242 |
| 3,572,626 | 3/1971 | Bertschi | 248/243 |
| 3,729,161 | 4/1973 | Christensen | 248/242 |
| 4,065,088 | 12/1977 | Shell | 248/242 |
| 4,098,480 | 7/1978 | Neumann | 248/242 |
| 4,378,925 | 4/1983 | Griffin | 248/242 |
| 4,548,378 | 10/1985 | Worrallo | 248/242 |
| 4,658,968 | 4/1987 | Mastrodicasa | 211/187 |
| 4,671,481 | 6/1987 | Beard | 248/243 |
| 4,708,252 | 11/1987 | Azzi | 211/187 |
| 4,854,535 | 8/1989 | Winter et al. | 248/243 |
| 4,938,442 | 7/1990 | Mastrodicasa | 248/243 |
| 4,951,908 | 8/1990 | Kallio | 211/90.01 |
| 5,076,648 | 12/1991 | Makainai | 248/242 |
| 5,088,607 | 2/1992 | Risafi et al. | 211/187 |
| 5,205,524 | 4/1993 | Cohen | 211/90.01 |
| 5,346,077 | 9/1994 | Randall | 248/243 |
| 5,348,385 | 9/1994 | Berg | 248/243 |
| 5,509,541 | 4/1996 | Merl | 248/242 |
| 5,575,444 | 11/1996 | Otema | 248/242 |
| 5,695,078 | 12/1997 | Otema | 211/90.01 |
| 5,921,412 | 7/1999 | Merl | 211/187 |

*Primary Examiner*—Jerry Redman
*Assistant Examiner*—Jennifer E. Novosad
*Attorney, Agent, or Firm*—Amster, Rothstein & Ebenstein

[57] ABSTRACT

An assembly supporting a display shelf at a non-transverse angle to a support includes at least one elongate support, at least one transversely-extending display shelf and angling brackets. Each elongate support defines a plane, an upright front surface and a plurality of longitudinally spaced first engaging elements facing forwardly in the support front surface. Each transversely-extending display shelf defines a generally upright back surface and at least one plurality of longitudinally spaced second engaging elements facing rearwardly from the shelf back surface. The plurality of second engaging elements are configured and dimensioned for cooperation and interconnection with the first engaging elements for releasable maintenance of the shelf in a plane transverse to the plane of the support. The angling brackets are interposed between the shelf back surface and the support front surface. The angling bracket defines an upright first surface and an angled second surface, the angling bracket second surface defining a single predetermined angle of about 5 to 15 degrees with respect to the angling bracket first surface for releasable retention of the shelf in a single predetermined plane angled to the plane of the support, but not transverse thereto.

19 Claims, 3 Drawing Sheets

DISPLAY SHELF ASSEMBLY AND BRACKET USEFUL THEREIN

BACKGROUND OF THE INVENTION

The present invention relates to an assembly for supporting a display shelf at a non-transverse angle to a support and to a bracket useful in such assembly.

A conventional assembly for supporting a display shelf on a vertical support includes at least one elongate support (typically at least a pair of such supports) and at least one transversely-extending display shelf. Each elongate support defines an upright front surface and a plurality of longitudinally spaced first engaging means facing forwardly in the support front surface. Each shelf defines a generally upright back surface and at least one plurality of longitudinally spaced second engaging means facing rearwardly from the shelf back surface. The plurality of second engaging means are configured and dimensioned for cooperation and interconnection with the first engaging means for releasable maintenance of the shelf in a plane transverse to the plane of the support.

Such assemblies are well-known in the prior art, the supports and shelves typically being kept in reserve by a store, ready for use in maintaining the shelves transverse (perpendicular) to the supports. On the other hand, where the articles to be sold from a display tray are to be gravity fed along a track as a result of the angular disposition of the top surface of the shelf upon which the display shelf rests, the store must also store at least one additional transversely-extending display shelf having the second engaging means thereof configured and dimensioned for cooperation and interconnection with the support first engaging means for releasable maintenance of the shelf in a non-transverse plane to the plane of the support.

Thus, if a retailer is to display both non-gravity fed and gravity-fed products, he must store a rather large quantity of shelves, some of the shelves being suitable for the non-gravity-fed products and the other ones for the gravity-fed products. The storage of this large quantity of shelves may not be possible due to space considerations and, in any case, increases the necessary financial investment in the shelves. Thus, it would be desirable to provide a support assembly which utilized conventional supports and conventional shelves, with the shelves being releasably maintained in a plane either transverse or non-transverse to the plane of the support, as desired by the retailer at a given time.

In certain instances, the thickness of the shelf may vary from the front thereof to the back thereof so that, when the bottom of a display shelf is disposed in a horizontal plane, the upper surface of the shelf is inclined forwardly and downwardly to provide for a gravity-feed orientation. Alternatively, the display tray to be placed on the display shelf may contain its own means for inclining the article-supporting tracks thereof so as to provide for a gravity-feed orientation despite a horizontal shelf top. Such variable thickness shelves and self-inclining display trays are not within the scope of the present invention as they always provide for a gravity-feed orientation.

Accordingly, it is an object of the present invention to provide an assembly for supporting a display shelf at an angle to a support, the shelf being releasably maintained by the support in either an inclined orientation (for gravity-fed displays) or in a horizontal orientation (for non-gravity-fed displays).

Another object is to provide an assembly which reduces the number of shelves which must be stored by the retailer.

A further object is to provide a bracket or angling means which may be used in such an assembly in order to releasably maintain the shelf in a plane non-transverse to the plane of the support.

SUMMARY OF THE INVENTION

The above and related objects of the present invention are obtained in an assembly for supporting a display shelf at a non-transverse angle to a support. The assembly comprises at least one elongate support, at least one transversely-extending display shelf, and angling means. Each elongate support defines an upright front surface and a plurality of longitudinally spaced first engaging elements facing forwardly in the support front surface. Each transversely-extending display shelf defines a generally upright back surface and at least one plurality of longitudinally spaced second engaging elements facing rearwardly from the shelf back surface. The plurality of second engaging elements are configured and dimensioned for cooperation and interconnection with the first engaging elements for releasable maintenance of the shelf in a plane transverse to the plane of the support. The angling means are angling brackets interposed between the shelfback surface and the support front surface. The angling brackets define an upright first or back surface and an angled second or front surface, the angling bracket second surface defining an angle of about 5 to 15 degrees with the angling bracket first surface. The angling bracket second surface defines a plurality of longitudinally spaced engaging elements facing forwardly and being configured and dimensioned for cooperation and interconnection with the second engaging elements of the shelf for releasable maintenance therein of the second engaging elements of the shelf, the angling bracket first surface defining a plurality of longitudinally spaced engaging elements facing rearwardly from the angling bracket first surface and being configured and dimensioned for cooperation and interconnection with the first engaging elements of the support for releasable maintenance of the shelf in a plane angled to the plane of the support, but not transverse thereto.

In a preferred embodiment, the angle is about 9 to 10 degrees. The first or front engaging means of the support are apertures, and the second or back engaging means of the shelf are lugs (preferably L-shaped and extending rearwardly and downwardly). The angling bracket first or front surface engaging means are apertures, and the angling bracket second or back surface engaging means are lugs.

The present invention also encompasses the angling bracket alone as a bracket for supporting a display shelf at a non-transverse angle to a support.

BRIEF DESCRIPTION OF THE DRAWING

The above and related objects, features and advantages of the present invention will be more fully understood by reference to the following detailed description of the preferred, albeit illustrative, embodiments thereof when taken in conjunction with the accompanying drawing wherein.

DETAILED DESCRIPTION OF THE PREFERRED EMBODIMENTS

Figure 1:
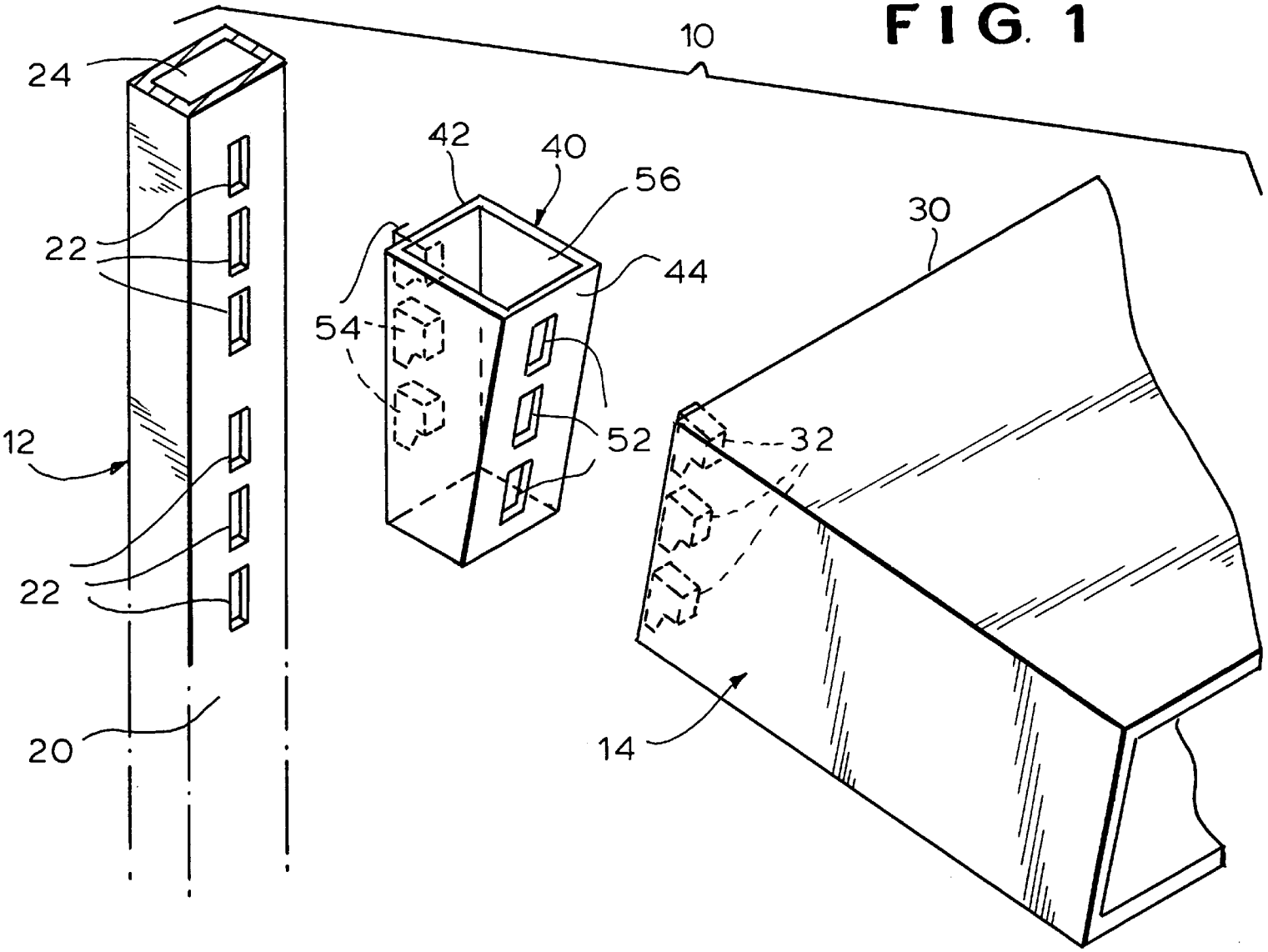
FIG. 1 is a fragmentary exploded isometric view of an assembly according to the present invention.
Figure 2:
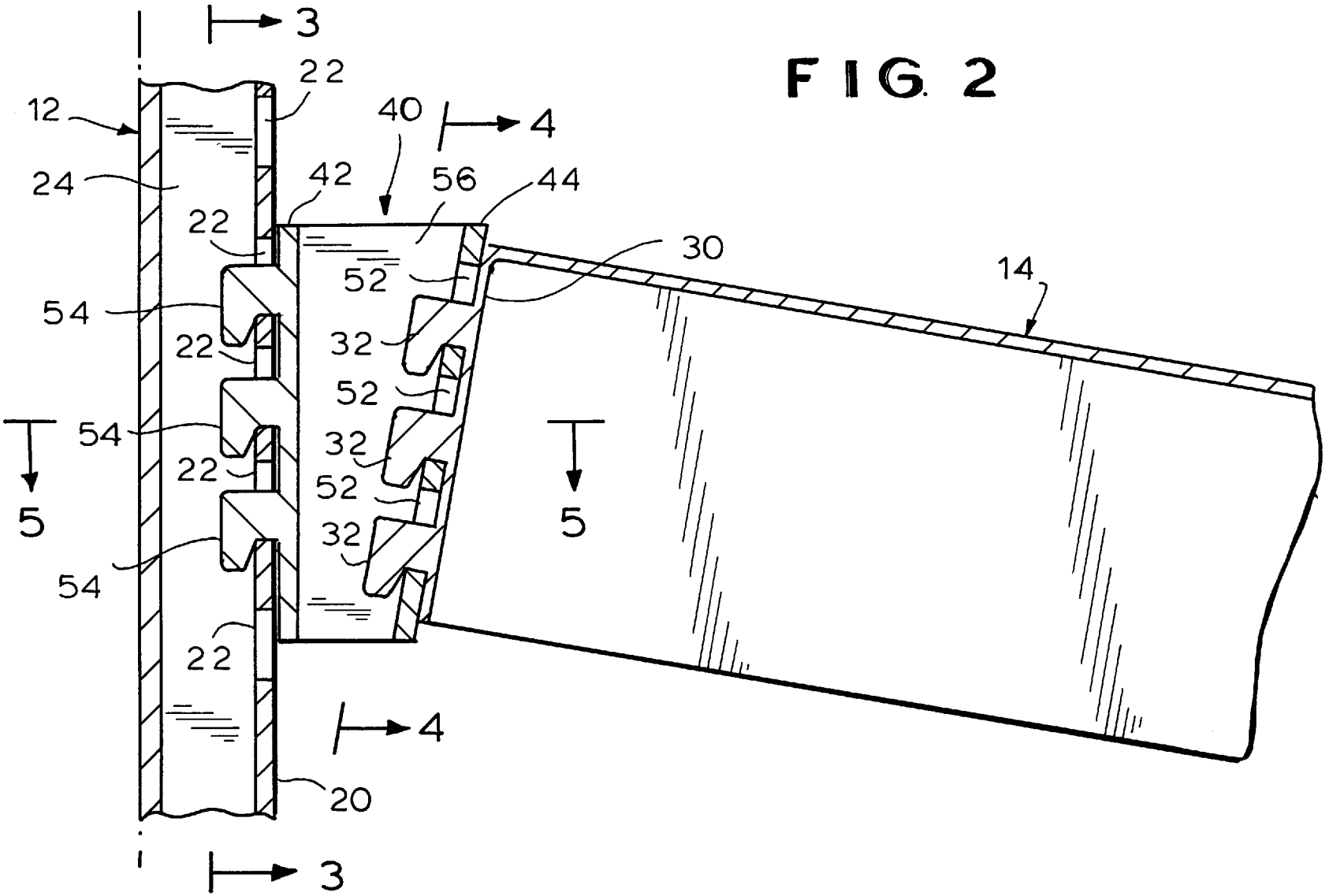
FIG. 2 is a fragmentary assembly view thereof, to a slightly enlarged scale and partially in sections.
Figure 5:
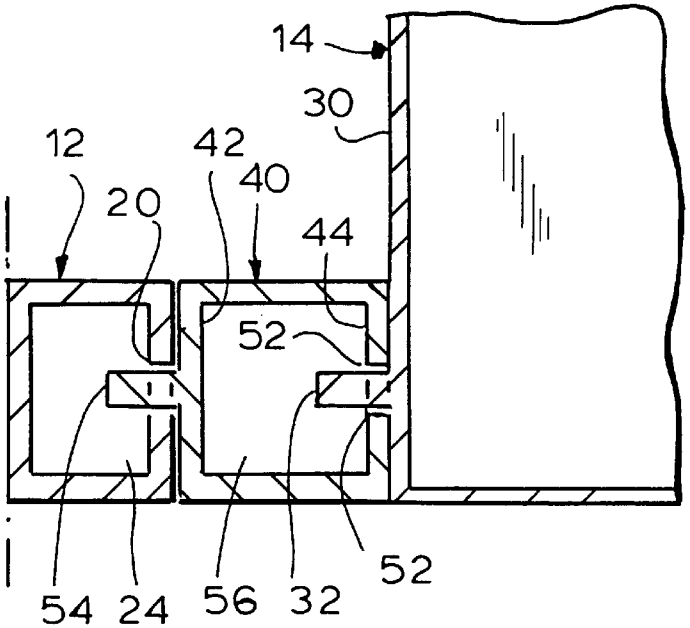
FIGS. 3, 4 and 5 are sectional views taken along the lines 3—3, 4—4 and 5—5, respectively, of FIG. 2.
Figure 4:
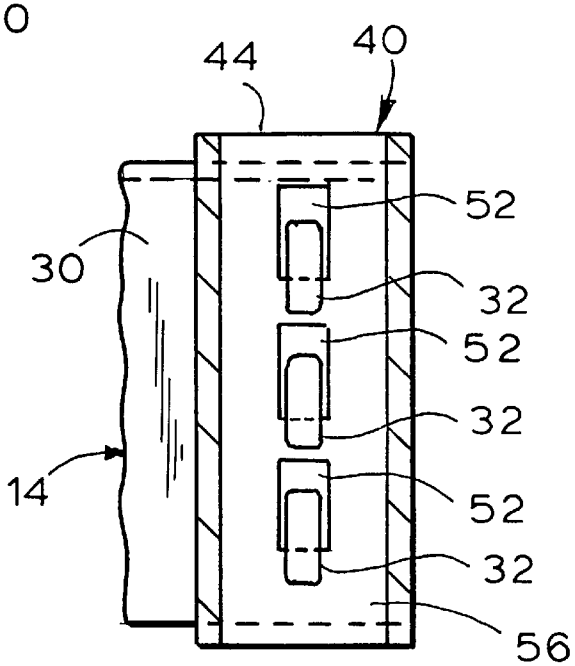
Figure 3:
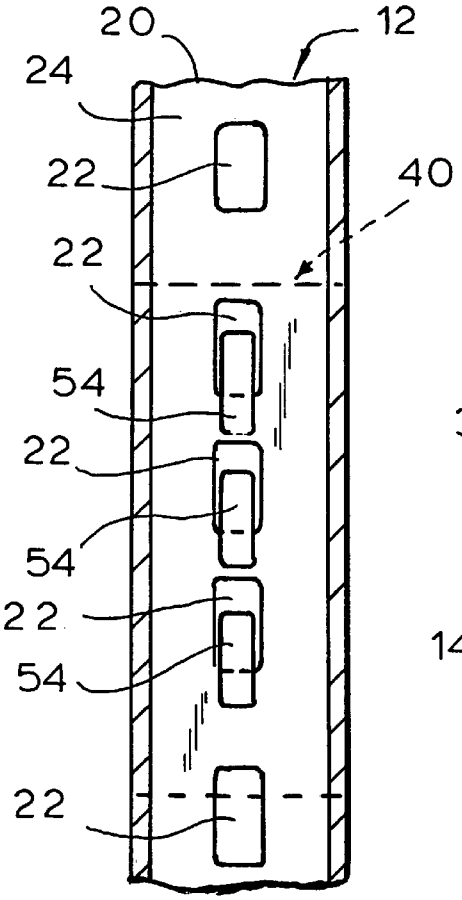

Referring now to the drawing, and in particular FIGS. 1 and 2 thereof, therein illustrated is an assembly according to the present invention, generally designated by the reference numeral 10. In its conventional aspects the assembly 10 comprises at least one elongate support generally designated 12 and at least one transversely-extending display shelf generally designated 14.

More particularly, the support 12 defines an upright front surface 20 and a plurality of a longitudinally spaced first or front engaging means 22 facing forwardly in the support front surface 20. As illustrated, the support is configured and dimensioned such that the first engaging means 22 thereof provides access to the hollow 24. The plurality of the support first engaging means 22 may be regularly longitudinally spaced along a portion of the length of the front support surface 20 or, as illustrated in FIG. 1, may be grouped into subunits of two or more support first engaging means.

Each shelf 14 defines a generally upright back surface 30 and at least one plurality of longitudinally spaced second or back engaging means 32 facing rearwardly from the shelf back surface 30. Typically, there is at least one plurality of the shelf second engaging means at each end of the shelf back surface 30, with additional pluralities of shelf second engaging means 32 (not shown) optionally disposed intermediate the extreme ones to provide additional support (assuming that there is a support positioned for engagement by the additional pluralities of shelf second engaging means).

The plurality of shelf second or back engaging means 32 are configured and dimensioned for cooperation and interconnection with the plurality of support first or front engaging means 22 for releasable maintenance of the shelf 14 in a plane transverse (that is, at a right angle) to the plane of the support 12. Thus, the shelf 14 may be joined to the support 12 by the first and second engaging means 22, 32, respectively without any intermediate piece, thereby to maintain the shelf in a non-inclined orientation such that it is adapted for a non-gravity-fed display tray.

Typically, the support first engaging means 22 (on the support front surface 20) are apertures extending into the hollow 24, while the shelf second engaging means (projecting rearwardly from the shelf back surface 30) are lugs, preferably lugs which are L-shaped and extend rearwardly and then downwardly. The lugs 32 are configured and dimensioned to be received within the apertures 22 for releasable maintenance of the shelf in a plane transverse to the plane of the support. While the support first or front engaging means are female apertures 22 and the shelf second or back engaging means 32 are male lugs, clearly these may be reversed; indeed, a variety of other releasably interlocking or interconnecting securing means may be used instead.

Turning now to the novel aspects of the present invention, the assembly 10 additionally includes a bracket or angling means, generally designated 40, interposed between the shelf back surface 30 and the support front surface 20. The angling means 40 defines an upright first or back surface 42 and an angled second or front surface 44 (which extends upwardly and outwardly relative to the upright first or back surface 42). The angling means front surface 44 preferably defines an angle of about 5 to 15 degrees with the angling means back surface 42, optimally an angle of 9–10 degrees.

The angling means front surface 44 defines a plurality of longitudinally extending engaging means (like the first or front female engaging means 22 of the support front face 20) facing forwardly and being configured and dimensioned for cooperation and interconnection with the second or back male engaging means 32 of the shelf 14 for releasable maintenance therein of the shelf second or back male engaging means 32. The back surface 42 of the angling means 40 defines a plurality of longitudinally spaced engaging means (like the second or back male engaging means 32 of the shelf 14) facing rearwardly from the back surface 42 (i.e., projecting rearwardly therefrom) and being configured and dimensioned for cooperation and interconnection with the first or front female engaging means 22 of the support 12 for releasable maintenance of the shelf in a plane angled to the plane of the support, but not transverse thereto. In other words, the shelf 14 is maintained by angling means 40 at less than a right angle with the support 12.

The angling means 40, like the support 12, defines a hollow 56 extending longitudinally therethrough, the hollow 56 being engagable by the shelf second or back male engaging means 32 via apertures 52. The lugs 54, like the lugs 32, are preferably L-shaped, extending rearwardly and downwardly.

Thus, in the assembly of the present invention, the angling means 40, when used, acts as a bracket for supporting a display shelf 14 at a non-transverse angle to a support 12, while the absence of the angling means 40 enables a display shelf 14 to be supported at a transverse angle to a support 12.

It will be appreciated by those skilled in the art that the assembly greatly reduces the number of shelves 14 which must be stored by a retailer since each stored shelf may be directly fastened to the support 12 in order to maintain the shelf at a transverse angle or fastened via the bracket or angling means 40 in order to maintain the shelf at a non-transverse angle suitable for a gravity-feed display tray. Instead of storage of a large number of bulky and expensive shelves 14, some being suitable for a transverse orientation and some being suitable for a non-transverse orientation, compact and inexpensive brackets or angling means 40 may be stored in sufficient numbers to accommodate the maximum number of non-transverse orientations anticipated.

The bracket is preferably formed of a metal or other strong, rigid material capable of supporting the shelf (as well as any articles placed on the shelf) at an angle to the support.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

I claim:

1. An assembly supporting a display shelf at a non-transverse angle to a support, said assembly comprising:

(A) at least one elongate support defining a plane an upright front surface and a plurality of longitudinally spaced first engaging means facing forwardly in said support front surface;

(B) at least one transversely-extending display shelf, each said shelf defining a generally upright back surface and a plurality of longitudinally spaced second engaging means facing rearwardly from said shelf back surface, said plurality of second engaging means being configured and dimensioned for cooperation and interconnection with said first engaging means for releasable retention of said shelf in a plane transverse to the plane of said support; and (C) angling means interposed between said shelf back surface and said support front surface, said angling means defining an upright first surface and an angled second surface, said angling means second surface defining a single predetermined angle of 5 to about 15 degrees with respect to said angling means first surface, said angling means second surface defining a plurality of longitudinally spaced engaging means facing forwardly and being configured and dimensioned for cooperation and interconnection with said second engaging means of said shelf for releasable retention therein of said second engaging means of said shelf, said angling means first surface defining a plurality of longitudinally spaced engaging means facing rearwardly from said angling means first surface and being configured and dimensioned for cooperation and interconnection with said first engaging means of said support for releasable retention of said shelf in a single predetermined plane angled to the plane of said support, but not transverse thereto.

2. The assembly of claim 1 wherein said angle is about 9–10 degrees.

3. The assembly of claim 1 wherein said support first engaging means are apertures and said shelf second engaging means are lugs.

4. The assembly of claim 3 wherein said lugs are L-shaped, extending rearwardly and downwardly.

5. The assembly of claim 3 wherein said angling means first surface engaging means are apertures, and said angling means second surface engaging means are lugs.

6. The assembly of claim 1 wherein said angling means first surface engaging means are apertures, and said angling means second surface engaging means are lugs.

7. The assembly of claim 6 wherein said lugs are L-shaped, extending rearwardly and downwardly.

8. The assembly of claim 1 wherein said angling means is devoid of any means for engaging either of said shelf and said support intermediate said first and second surfaces of said angling means.

9. The assembly of claim 1 wherein said shelf is secured to said angling means only by the engagement of said second engaging means of said shelf and said second surface engaging means of said angling means.

10. An assembly supporting a display shelf at a non-transverse angle to a support, said assembly comprising:

(A) at least one elongate support defining a vertical plane, an upright front surface and a plurality of longitudinally spaced female engaging means facing forwardly in said support front surface;

(B) at least one transversely-extending display shelf, each said shelf defining a generally upright back surface and a plurality of longitudinally spaced male engaging means facing rearwardly from said shelf back surface, said plurality of male engaging means of said shelf being configured and dimensioned as lugs for cooperation and interconnection with said support female engaging means for releasable retention of said shelf in a plane transverse to the plane of said support; and (C) angling means interposed between said shelf back surface and said support front surface, said angling means defining an upright back surface and an angled front surface, said angled front surface of said angling means defining a single predetermined angle of 5 to about 15 degrees with respect to said back surface of said angling means, said angled front surface of said angling means defining a plurality of longitudinally spaced female engaging means facing forwardly from said angled front surface of said angling means and being configured and dimensioned as apertures for cooperation and maintenance with said male engaging means of said shelf for releasable retention therein, said back surface of said angling means defining a plurality of longitudinally spaced male engaging means facing rearwardly from said back surface of said angling means and being configured and dimensioned as lugs for cooperation and maintenance with said female engaging means of said support for releasable retention therein of said female engaging means of said support, thereby to releasably maintain said shelf in a single predetermined plane angled to the plane of said support, but not transverse thereto.

11. The assembly of claim 10 wherein said lugs are L-shaped, extending rearwardly and downwardly.

12. A bracket adapted to support a display shelf at a non-transverse angle to a support defining a vertical plane, said bracket comprising:

angling means interposed between a shelf back surface and a support front surface, said angling means defining an upright back surface and an angled front surface, said angling means front surface defining an angle of 5 to about 15 degrees with respect to said angling means back surface, said angling means front surface defining a plurality of longitudinally spaced engaging means facing forwardly and being configured and dimensioned for cooperation and interconnection with the shelf back surface, said angling means back surface defining a plurality of longitudinally spaced engaging means facing rearwardly from said angling means back surface and being configured and dimensioned for cooperation and releasable interconnection with the support front surface; said angling means being configured and dimensioned to releasably retain the shelf in a single predetermined plane angled to the plane of the support, but not transverse thereto.

13. The bracket of claim 12 wherein said angle is about 9 to 10 degrees.

14. The bracket claim 12 wherein said engaging means of said angling means front surface are apertures and said engaging means of said angling means back surface are lugs.

15. The bracket of claim 14 wherein said lugs are L-shaped, extending rearwardly and downwardly.

16. The bracket of claim 12 wherein said angling means is devoid of any means for engaging either of said shelf and said support intermediate said first and second surfaces of said angling means.

17. The bracket of claim 12 wherein said shelf is secured to said angling means only by the engagement of said shelf back surface and said engaging means of said angling means front surface.

18. A bracket adapted to support a display shelf at a non-transverse angle to a support defining a vertical plane, said bracket comprising:

angling means interposed between a shelf back surface and a support front surface, said angling means defining an upright back surface and an angled front surface, said angled front surface of said angling means defining an angle of 5 to about 15 degrees with respect to said back surface of said angling means, said angled front surface of said angling means defining a plurality of longitudinally spaced female engaging means facing forwardly from said angled front surface of said angling means and being configured and dimensioned as apertures for cooperation and retention with male engaging means of the shelf for releasable retention therein said back surface of said angling means defining a plurality of longitudinally spaced male engaging means facing rearwardly from said back surface of said angling means and being configured and dimensioned as lugs for cooperation and retention with female engaging means of the support for releasable maintenance therein, said angling means being configured and dimensioned to releasably retain the shelf in a single predetermined plane angled to the vertical plane of the support, but not transverse thereto.

19. The bracket of claim 18 wherein said lugs are L-shaped, extending rearwardly and downwardly.

* * * * *